United States Patent [19]

Wheat et al.

[11] Patent Number: 5,075,917

[45] Date of Patent: Dec. 31, 1991

[54] BUMPER MOUNTED SHOE CLEANER

[76] Inventors: George A. Wheat, 7030 N. 2nd St., Phoenix, Ariz. 85020; James F. Desmond, 230 W. Montebello Ave., Phoenix, Ariz. 85013

[21] Appl. No.: 600,511

[22] Filed: Oct. 19, 1990

[51] Int. Cl.[5] ..... A46B 15/00

[52] U.S. Cl. ..... 15/161; 15/160; 15/217; 15/231; 15/246; 280/762

[58] Field of Search ..... 15/160, 161, 187, 188, 15/215-217, 222, 231, 246; 280/762; 248/110

[56] References Cited

U.S. PATENT DOCUMENTS 1,137,354 4/1915 Ruddimann ..... 15/217
1,157,631 10/1915 McLaughlin ..... 15/217
1,316,902 9/1919 Kottler ..... 15/217
1,954,940 4/1934 Mikel ..... 15/216

*Primary Examiner*—Timothy F. Simone
*Assistant Examiner*—Mark Spisich
*Attorney, Agent, or Firm*—Richard G. Harrer; Charles E. Cates

[57] ABSTRACT

An apparatus for cleaning the soles and heels of shoes and which is adapted to be mounted to the bumper of a vehicle. The apparatus comprises a flexible base member on which bristle-like projections are secured and securing members attached to the ends of the base for attaching the apparatus to the upper and lower surface of a bumper. One of the securing members including a band which is length-adjustable for either tightening or loosening the base to the bumper.

6 Claims, 1 Drawing Sheet

FIG. 1
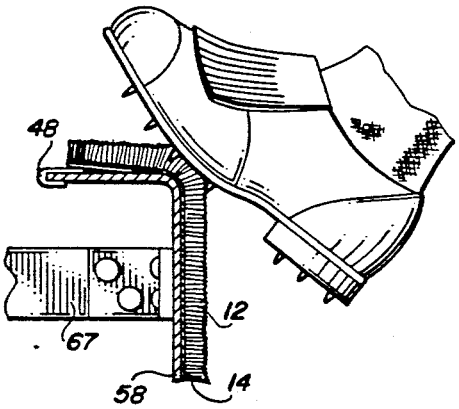
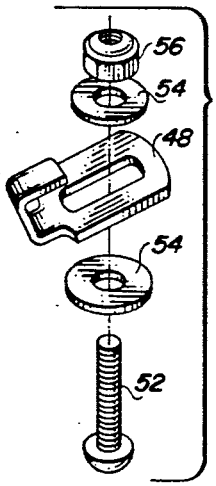
FIG. 3
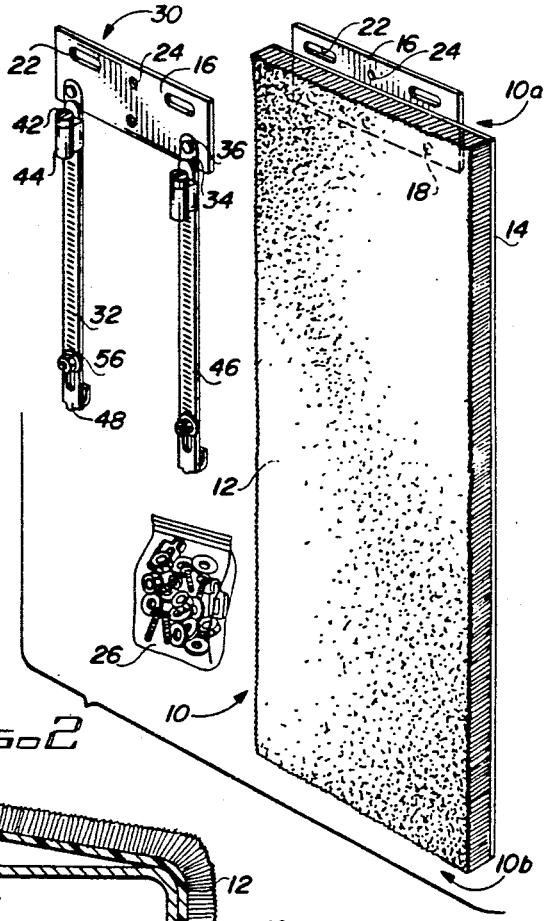
FIG. 2
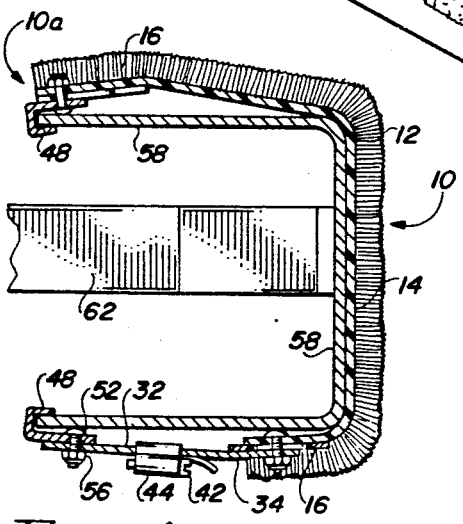
FIG. 4
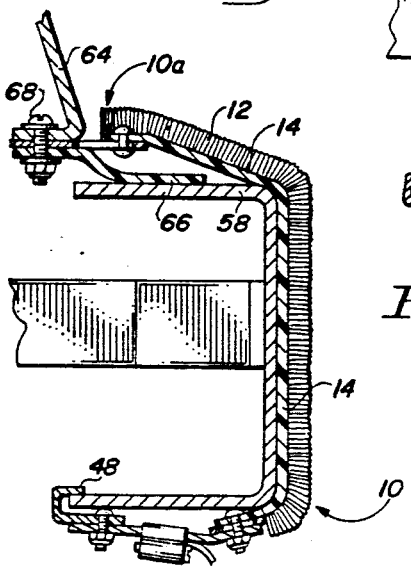
FIG. 5
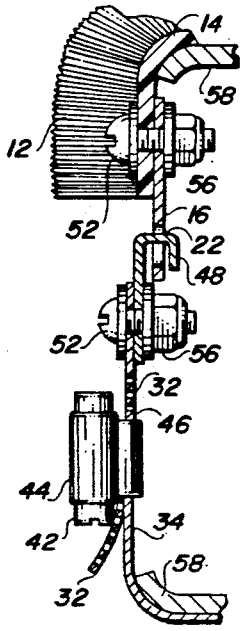
FIG. 6

BUMPER MOUNTED SHOE CLEANER

BACKGROUND OF THE INVENTION

1. Field of the Invention

This invention relates to apparatus for cleaning dirt and grass from shoes and particularly from sport shoes such as cleated or spiked golf shoes and more particularly to such apparatus which is mounted to a vehicle bumper.

2. Description of Prior Art

Most golfers wear shoes provided with cleats or spikes on both the sole and heel of the shoes to provide the golfer with a sure footing while making the golf shot. During play, the presence of the cleats causes dirt to build up on the exposed portion of the heel and sole of each shoe and can interfere with the most effective use of such shoes. Many golf courses use "scrub brush" type devices which are provided at various points throughout the course and at the clubhouse as well which allow the golfer to clean the dirt and debris from the soles of the golf shoes.

Additionally, different types of golf shoe cleat cleaners have been devised to remove such impacted dirt and debris. For example, U.S. Pats. No. 2,980,936, 3,270,360, 4,571,767 and 4,670,932 describe hand-held tools which can be used to clean dirt from golf shoe cleats. Also, in U.S. Pat. No. 3,028,617, a golf shoe cleaner is described which is attached to a mobile golf club bag carrier. This latter cleaner probably has some advantage over the hand-held shoe cleaning devices, although to operate it it must be attached to a mobile bag carrier. The device of the U.S. Pat. No. "617" patent perhaps would not be of much value to a golfer who did not choose to pull a mobile bag carrier.

Golfers who do not belong to a "club" in which membership includes the use of locker facilities where the golfers equipment, clothing including golf shoes may be stored, need to carry such equipment and clothing with them when they go to the golf course. It is a common sight in a parking lot at a golf course to see golfers drive up in their vehicles, open the trunk of the car, take out their golf shoes and then proceed to remove their conventional shoes and put on the cleated golf shoes. In doing this the golfers frequently will place their foot with the shoe on the bumper of the vehicle, first to remove their street shoes and then to lace up the golf shoes. The presence of the cleats on the sole and heel of a golf shoe can, of course, very easily scratch or mar the surface of the vehicle's bumper, particularly the bumpers of some newer cars which are frequently provided with a plastic covering.

SUMMARY OF THE INVENTION

It would thus be desirable to have an apparatus which can be mounted to a vehicle bumper and which would provide a two-fold advantage: protect the bumper against possible marring by the cleats of sport shoes such as golf shoes, and, at the same time provide means for cleaning the sole and heel area of such cleated shoes.

The apparatus of this invention provides the foregoing advantages by means of a relatively flexible base member which is provided with means for both cleaning the sole and heel of cleated shoes and to protect the finish of the bumper, as well as means for securing the cleaning and protecting means to the vehicle bumper. In a preferred embodiment such securing means are adjustable allowing the apparatus to be mounted on a variety of bumper sizes and shapes.

BRIEF DESCRIPTION OF THE DRAWINGS

FIG. 1 is a part sectional and part perspective view showing a golfer cleaning his golf shoe with the apparatus of this invention mounted to the vehicle bumper;

FIG. 2 is a perspective view of the principal components of the apparatus of this invention;

FIG. 3 is a perspective view of some of the hardware used to mount the golf shoe cleaner to a vehicle bumper;

FIG. 4 is a vertical section through a vehicle bumper provided with the golf shoe cleaning apparatus of this invention;

FIG. 5 is a vertical section of a vehicle bumper showing another technique for mounting the apparatus of this invention; and FIG. 6 is a part-vertical section showing a still further means of mounting the apparatus of this invention to a vehicle bumper.

DESCRIPTION OF THE PREFERRED EMBODIMENTS

The components of the sport shoe cleaning and bumper protecting apparatus as taught by the present invention is generally shown in FIG. 2. The apparatus includes a length of cleaning means shown generally at 10 which means is provided with tufts of bristles 12 mounted to a flexible base or backing 14. The bristles may be made from nylon or other materials customarily used in the manufacture of brushes, but an especially desirable material for the cleaning means 10 is an artificial grass-like scrubber in sheet form and sold under the trademark "Flair" and manufactured by Monsanto Company. The "Flair" material is provided with tufts of polyethylene bristles bonded to a flexible backing and this material serves very well not only to clean the sole and heels of golf shoes but to protect the bumper as well. As shown, cleaning means 10 is generally rectangular in shape and of sufficient length to provide enough surface to give adequate cleaning of the sole and heel of the golf shoes as well as to protect the surface of the bumper. As further shown in FIG. 2, a bracket 16 is mounted at one end 10*a* of the cleaning means by means of fasteners 18. Bracket 16 is provided with a central opening 24 and side openings 22, which openings are used in securing the cleaning means to a vehicle bumper. Also shown in FIG. 2 is adjustable mounting means shown generally at 30 which means include bracket 16, which as shown is identical to the bracket 16 mounted to cleaning means 10. A pair of adjustable tension bands 32 are mounted to bracket 16. A worm drive assembly 44 is secured to strap 34 which strap in turn is attached to bracket 16 by fasteners 36. Worm assembly 44 engages slots 46 of adjustable bands 32. The worm is provided with slotted head 42 whereby turning the worm in a clockwise or counterclockwise direction will cause the band 32 to be lengthened or shortened. This worm and band construction is typically employed in adjustable clamps used in radiator hoses for vehicles and the like and is well known in the art. A hook 48 is attached to the free end of band 32 and, as shown in FIG. 3, hook 48 can be attached to the end of band 32 by means of machine screw 52, nut 56 and washers 54 or by other fastening means such as rivets. Adjustable mounting means 30 can be attached to end 10*b* of cleaning and protecting means 10 in a manner similar to that of bracket 16. Since the apparatus of this invention is designed to be mounted to a variety of vehicle bumpers, it is preferred that the apparatus be sold in kit form having the basic components shown in FIG. 2. That is, the cleaning and protecting means 10 is of a length that should adequately cover virtually all vehicle bumpers. Depending on requirements, the cleaning and protecting means may be cut to an appropriate length by the installer and thereafter the adjustable mounting means 30 is attached to end 10*b* by means of screws, nuts and washers. A package 26 of fasteners comprising machine screws, nuts and washers, is included in the kit.

FIGS. 4–6 show a variety of installations of the apparatus. As shown in FIG. 4, a generally U-shaped bumper 58 is mounted to vehicle frame member 62. End 10*a* of cleaning and protecting means 10 is provided with bracket 16 and a pair of hooks 48 are attached to the bracket through openings 22. As shown, the hooks engage the upper edge of the bumper. The cleaning and protecting means 10 has been previously cut to a length such that it covers a substantial amount of the exposed surface of bumper 58. Adjustable mounting means 30 has been secured to end 10*b* of the cleaning and protecting means 10. Mounting means 30 is also provided with hooks 48 which engages the lower edge of bumper 58. A screwdriver is placed in slotted head 42 to turn the worm assembly 44 and thereby take up any slack and cause the apparatus to be well secured to the bumper.

A somewhat different installation is shown in FIG. 6 in that the mounting means attached to end 10*a* and the adjustable mounting means 30 are positioned behind bumper 58 and the hooks 48 of mounting means 30 engage openings 22 of bracket 16, which bracket is mounted to end 10*a* of cleaning and protecting means 10.

A further installation is shown in FIG. 5 and is useful in vehicles where a flexible vinyl molding is provided as a trim piece between the body of the vehicle and the bumper. Specifically, as shown in FIG. 5, a vinyl molding 66 is mounted to the sheet metal 64 of a vehicle body by means of fastener 68. In this particular installation, the fastener 68 is removed, and the bracket 16, which is attached to end 10*a* of cleaning means 10, is inserted between vinyl molding 66 and vehicle body 64 and the fastener is then replaced. This of course secures end 10*a* of the apparatus to the vehicle body rather than to the bumper. The opposite end 10*b* of the cleaning and protecting means 10 is then secured to the lower edge of the bumper 58 by means of the adjustable mounting means 30. As in the other installations, any slack in the installation may be taken up by means of turning the worm 44 which engages the slots 46 of strap 32 and provides a secure installation of the apparatus to the vehicle bumper.

We claim:

1. An apparatus for cleaning soles and heels of shoes and adapted to be mounted on the exposed surface of a vehicle bumper having upper and lower edges, said apparatus comprising a length of a generally rectangular shaped cleaning means having opposed ends and including a relatively flexible base member with tufts of bristle-like projections secured to said base member, adjustable means for mounting said cleaning means on the exposed surface of said vehicle bumper, said adjustable means including a first bracket mounted to one end of said cleaning means, a second bracket mounted to the opposite end thereof, with said first bracket having one end of an elongated tension band attached thereto, said tension band being provided with means for shortening or lengthening said band, with the free end of said band provided with hook means whereby said band may be engaged with one of the edges of said vehicle bumper, said second bracket being provided with hook means for engaging said bracket to the other of said edges of said bumper, whereby when both said hook means are engaged with said bumper, said means for shortening or lengthening said band can be operated to shorten said band and secure said apparatus to said bumper.

2. The apparatus of claim 1 wherein said second bracket is provided with means for securing said cleaning means to the body of said vehicle, whereby when said second bracket is secured to said vehicle body and said hook means of said first bracket is engaged with the lower edge of said bumper, said means for shortening or lengthening said band can be operated to shorten said band and secure said apparatus to said bumper.

3. The apparatus of claim 2 wherein said means for shortening or lengthening said band is a worm drive which engages a series of slots in said band.

4. The apparatus of claim 1 wherein said second bracket is provided with means whereby said hook means of said first bracket may be engaged with said second bracket whereby when said cleaning means is positioned on the exposed surface of said bumper, said hook means of said first bracket may be engaged with said second bracket behind the exposed surface of said bumper and said means for shortening or lengthening said band can be operated to shorten said band and secure said apparatus to said bumper.

5. The apparatus of claim 4 wherein said means for shortening or lengthening said band is a worm drive which engages a series of slots in said band.

6. The apparatus of claim 1 wherein said means for shortening or lengthening said band is a worm drive which engages a series of slots in said band.

* * * * *